US005916273A

United States Patent [19]

Hepfinger

[11] Patent Number: 5,916,273

[45] Date of Patent: Jun. 29, 1999

[54] WARP KNITTED PLUSH FABRIC

[75] Inventor: John M. Hepfinger, Greenville, S.C.

[73] Assignee: Milliken & Company, Spartanburg, S.C.

[21] Appl. No.: 08/871,862

[22] Filed: Jun. 9, 1997

[51] Int. Cl.[6] ..... D04B 21/04

[52] U.S. Cl. ..... 66/194; 66/202

[58] Field of Search ..... 66/194, 202

[56] References Cited

U.S. PATENT DOCUMENTS

| | | | |
|---|---|---|---|
| 4,209,559 | 6/1980 | Wada et al. | 428/91 |
| 4,712,281 | 12/1987 | Scheller | 28/162 |
| 5,167,096 | 12/1992 | Eltoukhy et al. | 51/281 |
| 5,557,950 | 9/1996 | Richards et al. | 66/194 |

FOREIGN PATENT DOCUMENTS

| | | |
|---|---|---|
| 53-139866 | 12/1978 | Japan . |
| 2-182952 | 7/1990 | Japan . |

*Primary Examiner*—James J. Bell
*Attorney, Agent, or Firm*—Terry T. Moyer; George M. Fisher

[57] ABSTRACT

A warp-knitted fabric of at least three-bar construction, which is comprised of multifilament synthetic pile yarns on the technical back which are raised or broken to produce a plush surface and monofilament synthetic ground yarns on the technical face, the pile yarns being comprised of microdenier filaments having a denier no greater than 1.1.

10 Claims, 1 Drawing Sheet

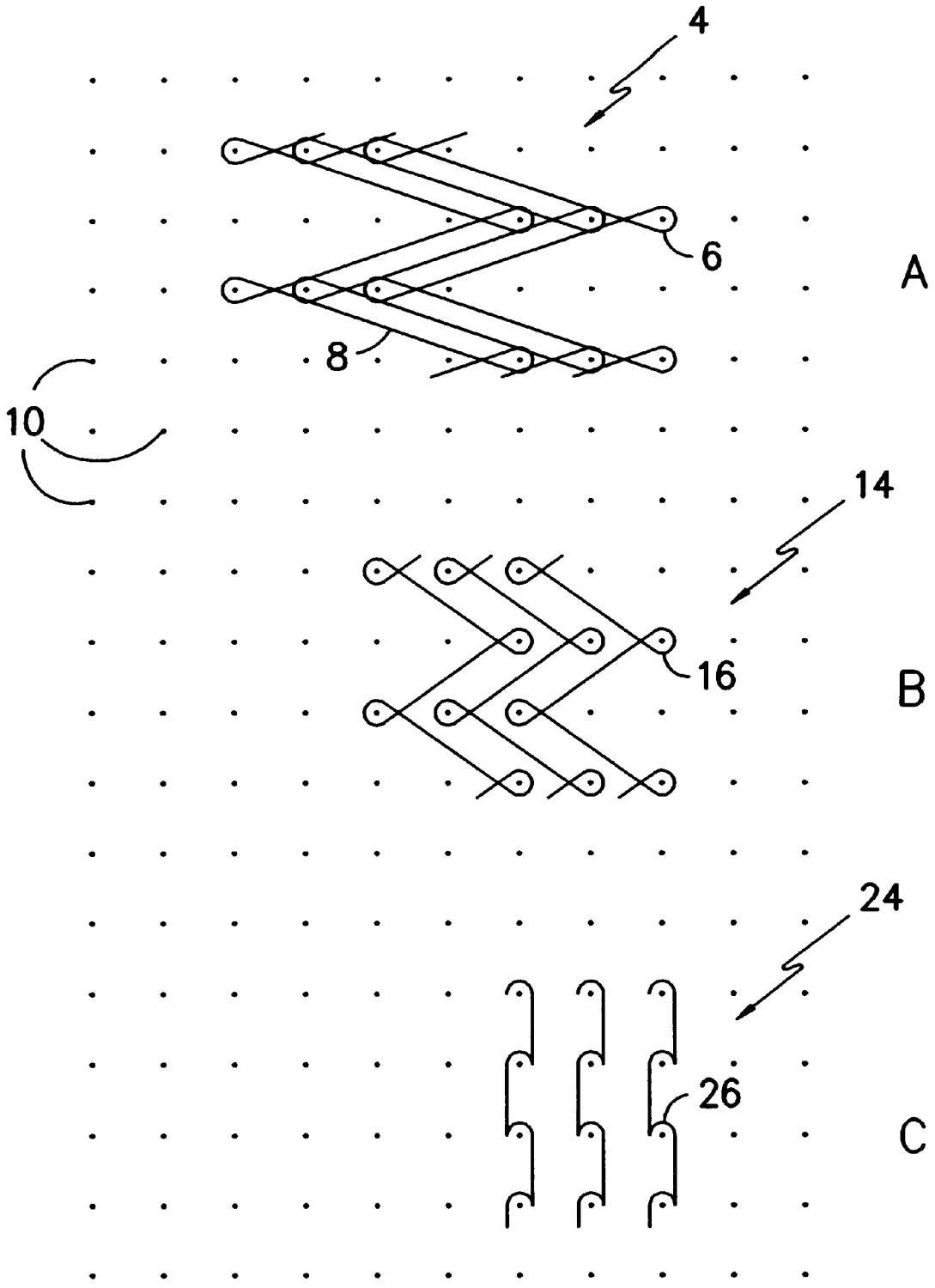
FIG. —1—

WARP KNITTED PLUSH FABRIC

BACKGROUND OF THE INVENTION

The present invention relates generally to knitted fabrics and methods of producing such fabrics. More specifically, this invention relates to a warp knitted fabric capable of being sanded, brushed, napped, sheared, or otherwise having the pile yarns of the technical back raised or broken to produce a plush surface.

In warp knitted fabrics, it is known that to create a plush raised surface on its technical back, one set of warp yarns must be knitted in a stitch pattern to produce an extended underlap of yarn on the technical back of the fabric. The technical back can then be brushed to allow the individual fibers of the yarn to be broken and raised to form a plush face. Often, these fibers must then be sheared, in an additional step, to produce a uniform plush face yielding a velour-like effect. However, problems may be encountered with the durability of these fabrics, in that the weakened structures may be susceptible to unwanted performance characteristics such as stretch, creep, and pilling.

SUMMARY OF THE INVENTION

It is accordingly an object of the present invention to provide an improved warp knitted plush fabric, and method of producing same, whose construction is uniquely suited to resist unwanted performance characteristics such as stretch, creep, and pilling.

Briefly described, these desired properties are achieved by using special ground and pile yarns that, in combination, work to resist fabric pilling while minimizing stretch and creep. In one embodiment, the invention is a textile fabric having at least three bar construction that is warp knitted, and is comprised of ground and pile yarns that are interlocked with one another and parallel to the fabric edge. The resulting stitches are arranged in horizontal rows, or courses, and vertical columns, or wales, formed by the knitting needles during one knitting cycle. In accordance with the present invention, the pile yarns are multifilament microdenier synthetic yarns. Microdenier yarns are generally regarded as being equal to or less than 1.1 denier for each filament. On the other hand, the ground yarns are synthetic monofilament yarns, each filament of which is no less than 10.0 denier.

The pile yarns are warp knitted with extended underlaps between the stitches on the technical back, to provide significant yarn area. This yarn area is subsequently raised by napping, sanding, brushing, or any other method that raises and breaks the filaments to form a plush surface. The ground yarns are warp knitted in a dimensionally stable stitch pattern, predominantly on the technical face of the fabric, to resist stretch of the fabric in a direction parallel to the fabric edge. In a preferred embodiment, for example, the pile yarns may be knitted in a 1-0, 4-5 stitch pattern, while the ground yarns are knitted in a 1-0, 0-1 and 1-0, 2-3 stitch pattern.

As described above, the pile yarns comprise the technical back of the fabric during fabric construction; however, after the pile yarns are raised to form a plush surface, the plush pile surface would logically be considered the face of the finished fabric. Conversely, the ground yarns, which comprise the technical face of the fabric during construction, would logically be considered the back of the finished fabric.

BRIEF DESCRIPTION OF THE DRAWINGS

FIG. 1 shows, via a conventional dot diagram, the stitch orientation for a preferred embodiment of the present invention, as knitted, for example, on a Tricot machine, and also details the pile yarn (technical back, indicated at A) and the two ground yarns (middle and technical face, indicated at B and C, respectively).

DESCRIPTION OF THE PREFERRED EMBODIMENTS

Referring to the accompanying drawing, FIG. 1 depicts a preferred embodiment of the invention, a warp-knitted three-bar construction knitted on a multi-bar knitting machine. The warp-knitting machine may be a conventional Raschel or Tricot warp-knitting machine, or any other machine of conventional three-bar (or more) construction, having three or more yarn guide bars and a needle bar. In accordance with conventional terminology, the bar construction of the warp-knitting machine refers to the number of yarn guide bars of the machine, while the bar construction of the warp knitted fabric refers to the number of different warp yarns included in the fabric. The set-up and operation of such machines are well known in the industry and the warp-knitting art, and will not be specifically described in detail.

The guide bars can be described as "top," "middle," and "bottom," or bar 1, bar 2, and bar 3, respectively. These designations are for reference purposes only. Individuals skilled in the art will understand that such terms describe a variety of knitting machines having guide bars that may also be referred to as "front," "middle," and "back" guide bars, respectively. Fabrics produced on these latter types of warp-knitting machines are intended to be included within the scope of the present invention.

Typically, machines are configured such that the guide bars of the machine each carry a series of aligned guides to hold the incoming yarn, while the needle bar carries a series of aligned knitting needles. The needle bar and the guide bars should be of the same gauge, that is, have the same number of needles or guides per inch. According to a preferred embodiment of the present invention depicted in FIG. 1, the bottom guide bar A is fully threaded, that is, each guide is threaded with one yarn, with a single set of yarns 4 delivered from a warp beam, while the middle and top guide bars B, C are also fully threaded with a second 14 and third 24 set of yarns, respectively, delivered from a second and third set of warp beams (not shown).

While it is possible to use a variety of yarns to create the plush fabric, it is preferred that the yarns be relatively stretch free to help provide dimensional stability to the fabric. In addition, it is further preferred that the bottom or pile yarns 4 in the bottom guide bar be multifilament synthetic yarns, and preferably microdenier polyester yarns, to provide a velvet hand and soft feel upon further processing. The denier of the pile yarns 4 may vary, depending upon the desired weight of the fabric for the particular end use, but the denier per filament of the yarn should not exceed 1.1 denier. On the other hand, the ground yarns 14, 24, associated with the middle and top guide bars, respectively, should be monofilament synthetic yarns, and preferably polyester. Monofilament polyester, being a single fiber without crimp or entanglement, will resist stretch and creep over time when exposed to a constant stress load. It is contemplated that each pile yarn 4 should have a total denier of at least 50 denier, and be comprised of at least about 50 individual filaments. Each of the ground yarns 14, 24 should have a total denier of at least 10 denier, with the total denier of the two ground yarns 14, 24 not exceeding that of the pile yarn 4.

A preferred embodiment of the present invention is illustrated in FIG. 1. Utilizing the teaching of the present invention, the stitch construction of the pile yarns 4 and two ground yarns 14, 24, as carried out by the respectively lateral traversing movements of the guide bars of the knitting machine, are illustrated in a conventional dot diagram, in which the individual points 10 represent the needles of the needle bar of the warp knitting machine in the formation of successive courses against several successive wales. According to this embodiment, the bottom guide bar (bar 3) of the machine manipulates the pile yarns 4 to traverse laterally back and forth relative to the needles 10 of the needle bar of the machine to stitch the pile yarns 4 in a repeating 1-0, 4-5 stitch pattern as indicated in A of FIG. 1. Simultaneously, the middle guide bar (bar 2) manipulates one set of ground yarns 14 as they are fed from their respective warp beam to traverse the knitting needles 10 to stitch the ground yarns in a repeating 1-0, 2-3 stitch pattern, as shown in B of FIG. 1. Again simultaneously, the top guide bar (bar 1) manipulates the other set of ground yarns 24 as they are fed from their respective warp beam to traverse in accordance to the needles 10 to stitch the ground yarns 24 in a repeating 1-0, 0-1 stitch pattern as shown in C of FIG. 1.

The pile yarns 4 are inter-knitted with one another and the ground yarns 14, 24. Each pile yarn 4 is formed in closed-needle loops 6 that alternate from course to course between wales, the wales being spaced apart by four intervening wales, the needle loops 6 being inter-knitted in relation with the closed-needle loops 16 of the ground yarn 14 in respective wales, and in elongated underlaps 8 extending diagonally between the successive needle loops 6 in a mostly course-wise direction, as indicated in A of FIG. 1. Each ground yarn 14 on the middle bar (bar 2) forms closed-needle loops 16 that alternate from course to course between wales spaced apart by one intervening wale in a stitch pattern 1-0, 2-3, as indicated in B of FIG. 1. Each ground yarn 24 on the top bar (bar 1) is knitted in a course-wise direction within singular wales, to form open-needle loops 26 in a stitch pattern 1-0, 0-1 on every needle 10, as indicated in C of FIG. 1.

The ground yarns 14, 24 form a base or substrate to the fabric essential for the pile yarns 4 to be held in a dimensionally stable support system. As those skilled in the art will understand, the stitch pattern of one set of ground yarns 24 reduces stretch in the machine direction of the fabric, while the stitch pattern of the other set of ground yarns 14 gives structural integrity to the fabric perpendicular to the machine direction. The underlaps 8 of the pile yarns 4 appear collectively at the technical back of the fabric to provide a smooth soft feel on the technical back, and to provide exposed fibers which can be further processed to change the subsequent look and feel of the fabric. These pile-like loops are exposed such that they may be readily napped, sanded, or brushed, or raised and broken through other means. If desired, the pile may then be sheared to create a uniform fiber height.

By breaking the fibers through any number of conventional methods, such as napping, sanding, brushing, or shearing, the underlaps of the pile yarn 8 are severed to form discrete pile yarn segments at each needle loop 6. These needle loops 6 are held into the base fabric by the ground yarns 14, 24 and their associated needle loops 16, 26. The microdenier yarn that comprises the pile yarn 4 has sufficient integrity to extend outwardly from the technical back of the fabric. The resulting surface of the technical back of the fabric has a smooth and soft velvet-like feel due to the plurality of raised fibers covering the ground structure.

Subsequent to the formation of the present fabric, the invention provides for finishing the fabric to provide enhanced physical properties in terms of fabric hand and wear performance.

In contrast to the prior art, the present invention's unique combination of yarn types and yarn sizes, as described above, resists the tendency of the fabric to stretch, creep or pill. In essence, by using microdenier yarns in the pile yarn, the individual filaments are more likely to completely break and separate from the fabric under abrasion than larger filaments. Therefore, fine denier yarn reduces the tendency of the fabric to have a pilling effect, whereby broken fibers accumulate on the surface of the fabric. The microdenier yarn also enhances the feel and softness of the fabric when further processed, as the filaments intermingle on the surface resulting in a velvet-like effect on the technical back. With the ground yarns possessing a smaller total denier than the pile yarns, the ground yarns are hidden by the microdenier pile yarn and are protected from processing damage. This enables the ground structure to remain intact and to serve as the structural base of the fabric. By using monofilament ground yarns, there is minimal stretch since there is no fiber entanglement and reduced fiber elongation. This reduced elongation helps to eliminate fabric creep when the fabric is placed under strain for extended periods.

Those individuals skilled in the art will recognize and understand that many adaptations of the present invention other than those described herein are readily apparent from or reasonably suggested by the present invention and the foregoing description thereof. As such, while the present invention is described herein in detail in relation to the preferred embodiment, it is to be understood that this disclosure is only illustrative and exemplary of the present invention, and that reasonable variations or modifications are possible within the spirit of the foregoing specification without departing from the scope of the invention. This disclosure is not intended or to be construed to limit the present invention or otherwise to exclude any other embodiments, adaptations, variations, modifications and equivalent arrangements, the present invention being limited only by the claims appended hereto and the equivalents thereof.

I claim:

1. A warp-knitted fabric of at least three-bar construction, said fabric comprised of multifilament synthetic pile yarns on the technical back which are raised or broken to produce a plush surface, and monofilament synthetic ground yarns on the technical face, wherein said pile yarns are comprised of microdenier filaments having a denier no greater than 1.1.

2. The fabric of claim 1, wherein said pile yarns have a denier of at least 50.

3. The fabric of claim 1, wherein said pile yarns are knitted in a 1-0, 4-5 stitch pattern.

4. The fabric of claim 1, wherein said monofilament synthetic ground yarns have individual deniers of at least 10.

5. The fabric of claim 1, wherein said ground yarns are comprised of at least two sets, one set being knitted in a 1-0, 0-1 stitch pattern, and another set being knitted in a 1-0, 2-3 stitch pattern.

6. The fabric of claim 1, wherein said monofilament synthetic ground yarns have a combined denier that does not exceed that of the pile yarn.

7. A process for manufacturing a dimensionally stable warp-knitted fabric having a plush raised surface on its technical back, said process being comprised of:

a. warp-knitting a fabric in which the technical back is comprised of a multifiliment synthetic yarn having a filament denier of 1.1 or less that is knitted in a way as to produce an extended underlap of yarn on said technical back, and the technical face is comprised of monofilament ground yarns in a dimensionally stable stitch pattern, and b. raising or breaking the multifiliment yarns comprising said extended underlap of yarn on said technical back of said fabric, thereby forming a plush raised surface.

8. The process of claim 7, wherein said pile yarns are knitted in a 1-0, 4-5 stitch pattern.

9. The process of claim 7, wherein said ground yarns are comprised of two sets of ground yarns, knitted in a 1-0, 0-1 and 1-0, 2-3 stitch pattern, respectively.

10. The process of claim 7, wherein said monofilament yarns are selected to have individual deniers of at least 10, and wherein said monofilament synthetic ground yarns are selected to have a combined denier that does not exceed that of the pile yarn.

* * * * *